US007383002B2

(12) United States Patent
Murata et al.

(10) Patent No.: US 7,383,002 B2
(45) Date of Patent: Jun. 3, 2008

(54) DEVELOPING DEVICE, PROCESS CARTRIDGE AND IMAGE FORMING APPARATUS

(75) Inventors: Hiroshi Murata, Kanagawa-ken (JP); Takao Izumi, Kanagawa-ken (JP); Takashi Hatakeyama, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 309 days.

(21) Appl. No.: 11/344,130

(22) Filed: Feb. 1, 2006

(65) Prior Publication Data

US 2006/0210318 A1 Sep. 21, 2006

(30) Foreign Application Priority Data

Mar. 18, 2005 (JP) ..... 2005-079966

(51) Int. Cl.
*G03G 15/08* (2006.01)

(52) U.S. Cl. ..... 399/257; 399/111; 399/119; 399/120; 399/260

(58) Field of Classification Search ..... 399/107, 399/111, 119, 120, 252, 254, 260, 262; 222/DIG. 1
See application file for complete search history.

(56) References Cited

U.S. PATENT DOCUMENTS

| | | | | |
|---|---|---|---|---|
| 5,761,584 | A * | 6/1998 | Tsuda et al. | 399/258 |
| 6,256,469 | B1 * | 7/2001 | Taniyama et al. | 399/258 |
| 6,351,620 | B1 * | 2/2002 | Miyabe et al. | 399/111 |
| 2007/0218389 | A1 * | 9/2007 | Honda et al. | 430/108.22 |

FOREIGN PATENT DOCUMENTS

| | | |
|---|---|---|
| JP | 07-121017 A | 5/1995 |
| JP | 08-022190 A | 1/1996 |
| JP | 11-219013 A | 8/1999 |

OTHER PUBLICATIONS

U.S. Appl. No. 10/940,624, filed Sep. 15, 2004, Murata.

* cited by examiner

*Primary Examiner*—Hoan Tran
(74) *Attorney, Agent, or Firm*—Foley & Lardner LLP

(57) ABSTRACT

A developer vent is provided on the wall of the developer container housing developer including toner and carrier for the developing device to overflow developer. The sectional shape of the discharge dam forming the developer vent in the vertical direction to the developer vent is such that the top part of the dam is made thinner than the wall thickness of the developer container and the slanting angle of the dam to the wall of the developer container is made larger than the repose angle of the developer.

12 Claims, 11 Drawing Sheets

DEVELOPING DEVICE, PROCESS CARTRIDGE AND IMAGE FORMING APPARATUS

CROSS REFERENCE TO RELATED APPLICATION

This application is based upon and claims the benefit of priority from the prior Japanese Patent Application No. 2005-079966, filed on Mar. 18, 2005; the entire of which are incorporated herein by reference.

BACKGROUND OF THE INVENTION

The present invention relates to a developing device, a process cartridge and an image forming apparatus of which shape of a discharging wall forming a developer vent improved to discharge developer through the overflow while supplying toner and carrier to a developer container.

Out of dry type two-component developer comprising toner and carrier, toner is consumed by the image forming but carrier remains in the developing device. The resin material coated on the surface of the remained carrier is peeled off, toner component is adhered to the carrier surface and the charging efficiency and others as developer are lowered. And as a result of the lower of charging efficiency of developer, image quality can be deteriorated.

In view of the above, a system to supply carrier separately from the supply of toner that is consumed in the image forming is proposed. Here, toner is consumed by the image formation but carrier remains in a developer container of a developing device. Therefore, when it is tried to maintain the toner density at a constant level, volume of developer in the developer container increases. The developer that becomes excess in the developer container overflowed and discharged through the developer vent provided on the wall surface of the developer container.

When developer is supplied and discharged repeatedly as described above, deteriorated developer in the developer container is replaced with newly supplied developer, the characteristic of developer was maintained favorably and volume of developer was maintained at a constant level.

In such the developing device, as disclosed in the Japanese Patent Application Publication No. 7-121017, the volume of developer discharged by the overflow was affected by the shape of the developer vent to discharge developer and some of them were formed in the characteristic shape.

The volume of developer discharged by the overflow is influenced by the shape of the developer vent and also by the sectional shape of the developer vent. For example, developer is discharged through the developer vent and at this time, developer is deposited on the tip part of the discharge dam forming the developer vent. As a result, the height of the discharge dam becomes substantially high and the area of the developer vent decreases. Thus, the developer discharging volume decreases and the volume of developer in the developer container increases.

SUMMARY OF THE INVENTION

The purpose of the present invention is to provide a developing device, a process cartridge and an image forming apparatus, which make fluctuation in volume of developer in the developer container small by stably discharging developer.

According to the embodiment of the present invention, there is provided a developing device comprising: a developer container to house developer comprising toner and carrier; a discharging part provided on a wall part of the developer container to discharge the developer; and a discharge dam of which tip part is in the thickness thinner than a thickness of the wall and an inclined angle in the horizontal direction is larger than a repose angle of the developer in the sectional shape and forms at least a part of the discharging part.

Further, according to the embodiments of the present invention, there is provided a process cartridge that is mounted detachably to an image forming apparatus, comprising: a photosensitive drum; a main charger to charge the surface of the photosensitive drum; a developing member to develop an electrostatic latent image formed on the surface of the photosensitive drum; a developer container to house developer comprising toner and carrier to be supplied to the developing member; a discharging part provided on a wall of the developer container to discharge the developer; and a discharge dam of which tip part is in the thickness thinner than a thickness of the wall and an inclined angle in the horizontal direction is larger than a repose angle of the developer in the sectional shape and forms at least a part of the discharging part.

Further, according to the embodiments of the present invention, there is provided an image forming apparatus comprising: a photosensitive drum; a main charger to charge the surface of the photosensitive drum; an exposing device to form an electrostatic latent image by exposing the surface of the photosensitive drum charged by the main charger; a developing member to develop the electrostatic latent image; a developer container to house developer comprising toner and carrier to be supplied to the developing member; a discharging part provided on a wall of the developer container to discharge the developer; and a discharge dam of which tip part is in the thickness thinner than a thickness of the wall and an inclined angle in the horizontal direction is larger than a repose angle of the developer in the sectional shape and, forms at least a part of the discharging part.

DETAILED DESCRIPTION OF THE EMBODIMENTS

One embodiment of the present invention will be explained below referring to the attached drawings. However, unless size, material, shape, etc. of components are specifically described in this embodiment, the scope of the present invention is not restricted.

Embodiment 1

Figure 1:
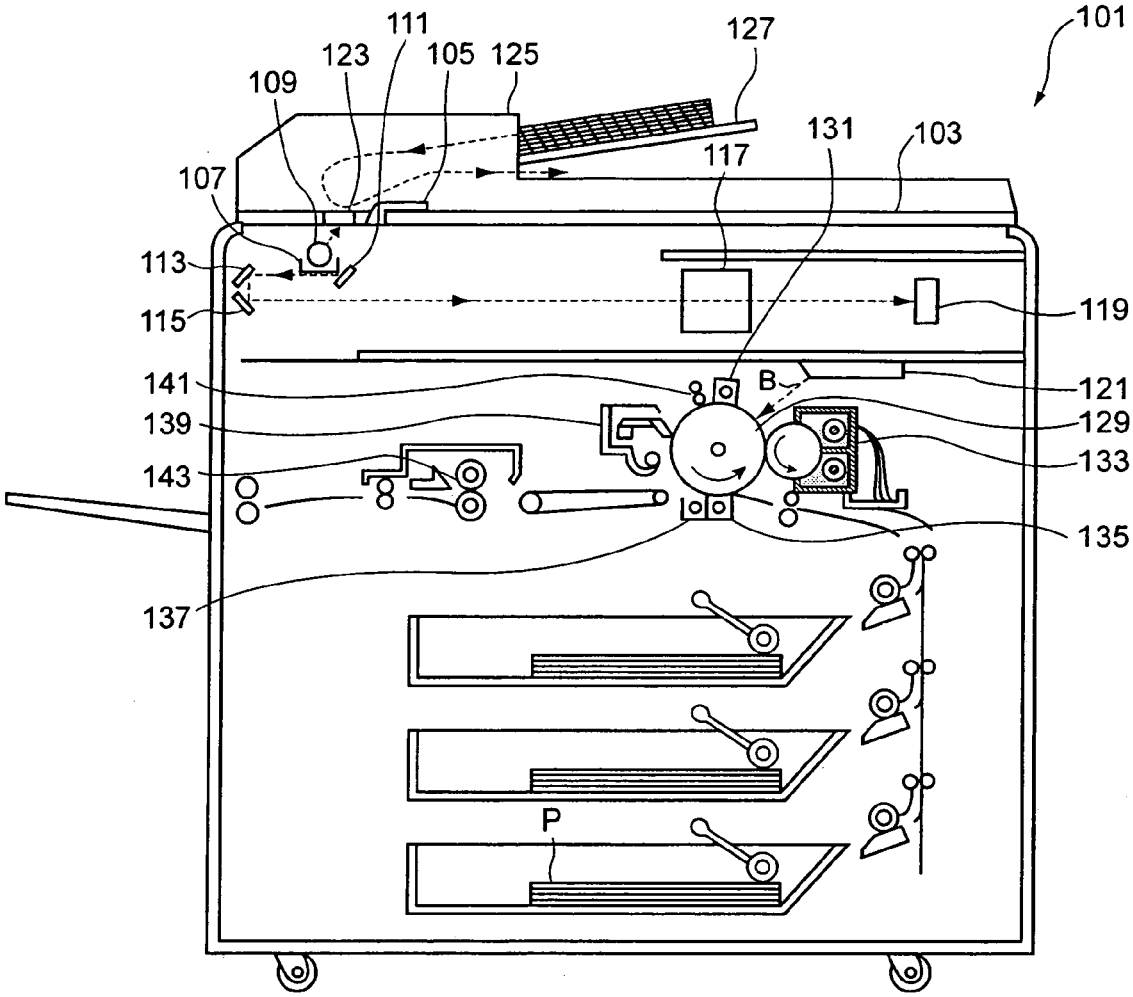
FIG. 1 is an internal construction diagram showing the main body of an image forming apparatus which is an embodiment of the present invention.

The overall construction of an image forming apparatus 101 involved in this embodiment is shown in FIG. 1. On the top of image forming apparatus 101, a transparent document table 103 is provided for placing documents. On one side of document table 103, an indicator 105 is provided. The difference in step between indicator 105 and document table 103 becomes the standard position for document setting.

On the underside of document table 103, a carriage 107 and an exposure lamp 109 are provided. An exposure unit is formed by carriage 107 and exposure lamp 109. Carriage 107 moves along the underside of document table 103. While carriage 107 moves reciprocating along document table 103, exposure lamp 109 lights and a document placed on document table 103 is exposed.

By this exposure, a reflected light image is obtained from the document and this reflected light image is projected to a CCD 119 by reflecting mirrors 111, 113 and 115 and a lens block 117. CCD 119 has many photoelectric transducers in the light receiving area. An image signal corresponding to a document image is output by repetitively making the line scanning of the light-receiving area.

The image signal output from CCD 119 is amplified and converted to a digital signal. This digital signal is properly image processed and supplied to a laser unit 121 that is an exposure unit. This laser unit 121 transmits laser beams corresponding to the input signal.

At the position adjacent to indicator 105 of document table 103, a window 123 for document reading is provided. Window 123 has dimensions and a shape corresponding to the longitudinal length of indicator 105. Above document table 103, indicator 105 and window 123, an automatic opening/closing document feeder 125 that also serves as a cover of document table 103 is provided. Automatic document feeder 125 has a tray 127 for placing documents and feeds plural number of documents set on tray 127 to window 123 one by one and discharges documents passed above window 123 onto tray 127. When automatic document feeder 125 is operated, exposure lamp 109 emits light at a position corresponding to window 123 and this light is irradiated to window 123. The light irradiated to window 123 exposes a document passing above window 123 through window 123. By this exposure, a reflecting light image is obtained from a document and projected to CCD 119 by reflecting mirrors 111, 113 and 115 and lens block 117.

On the other hand, nearly at the center of image forming apparatus, a photosensitive drum 129 is rotatably provided. Around photosensitive drum 129, a main charger 131, a developing device 133, a transferring device 135, a separation device 137, a cleaner 139 and a charge eliminator 141 are sequentially arranged. A fixing device 143 fixes the developer image transferred on a paper by transferring device 135. The laser beam transmitted from a laser unit 121 is irradiated to the surface of photosensitive drum 129 through a space between main charger 131 and developing device 133.

Figure 2:
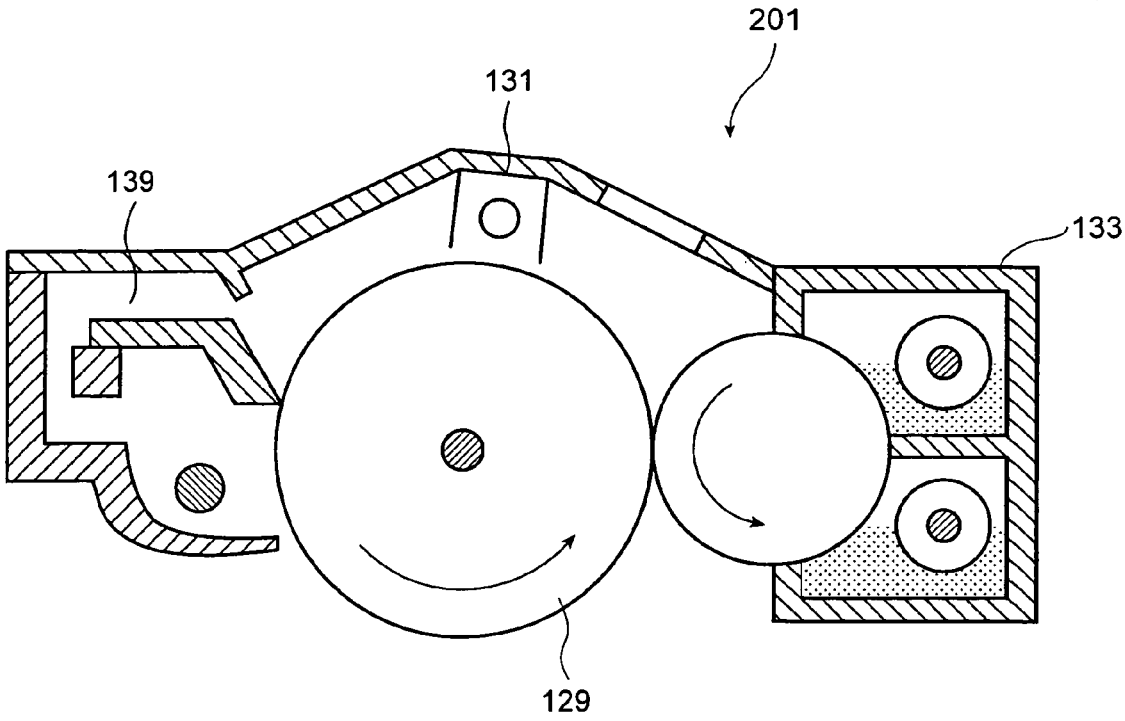
FIG. 2 is a cross-sectional view of the process cartridge which is an embodiment of the present invention.

As shown in FIG. 2, photosensitive drum 129, main charger 131, developing device 138 and cleaner 139 are unitized and are installed to image forming apparatus 101 detachably as a process cartridge.

Figure 3:
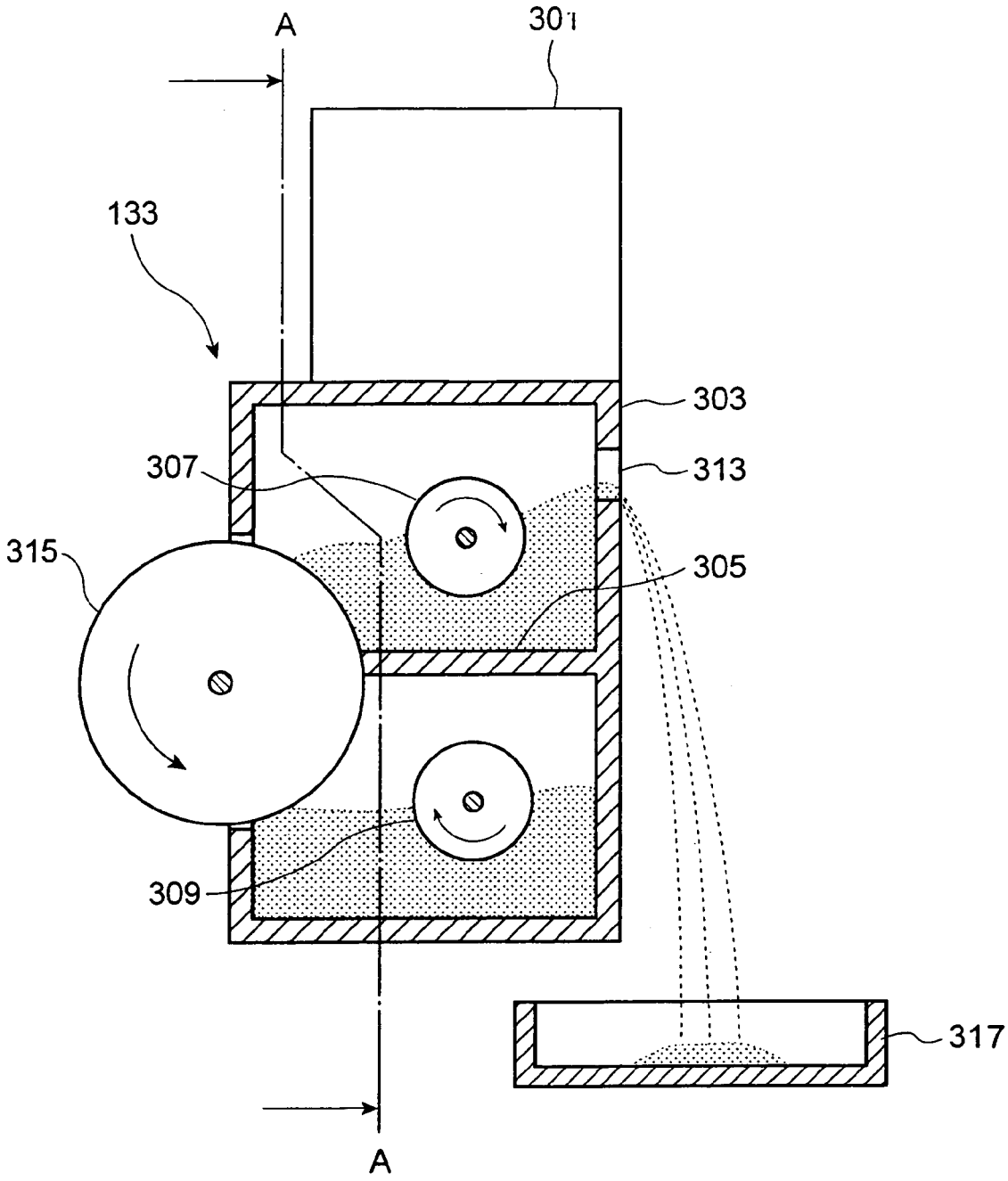
FIG. 3 is a cross-sectional view of the developing device which is an embodiment of the present invention.
Figure 4:
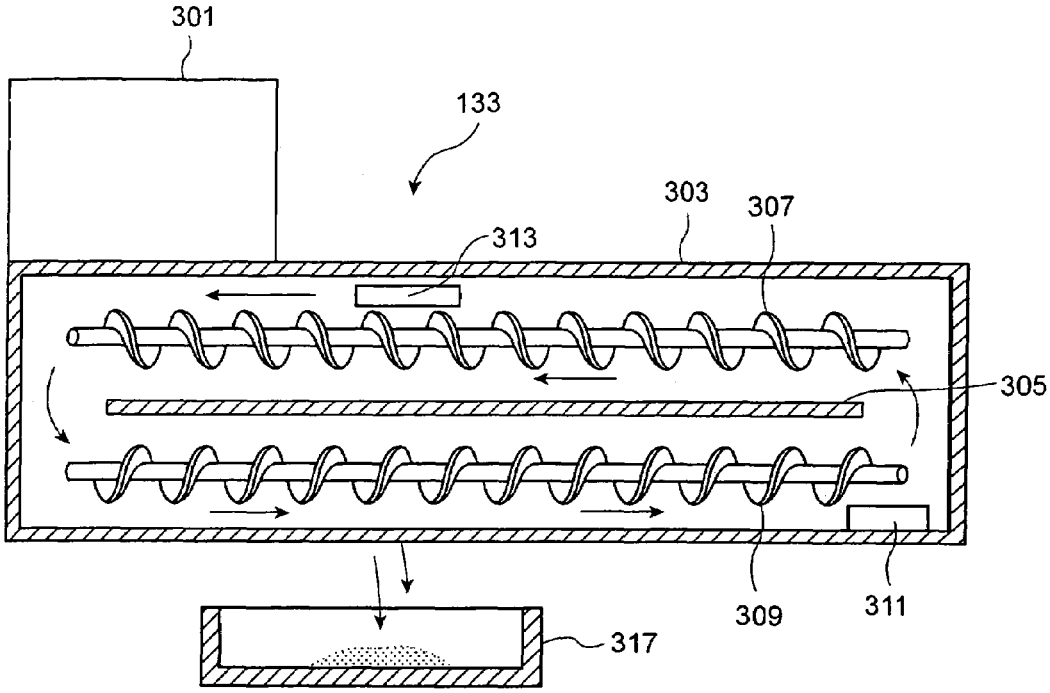
FIG. 4 is a front view of the cross-section along the line A-A viewed in the arrow direction.

Next, developing device 133 in a process cartridge 201 will be explained. FIG. 3 is the inside of developing device 133 viewed from the side. Shown in FIG. 4 is a cross-sectional surface along the line A-A shown in FIG. 3 viewed in the arrow direction. As shown in FIG. 3, developing device 133 is equipped with a developer supply container 301 housing two-component developer; that is, toner and carrier. Further, developing device 133 is also provided with a developer container 303 in which a developing roller 315 is provided rotatably as a developing part. Developing roller 315 is arranged by facing to photosensitive drum 129 and supplies toner to photosensitive drum 129 by rotating. Toner and carrier are supplied to developer container 303 as developer supply container 301 is attached. Developer container 303 is separated into the upper space and the lower space by a partition board 305. Toner and carrier are supplied in the upper space from developer supply container 301. The upper and lower spaces are communicated respectively at both sides. As a means to circulate developer mutually between the upper and lower spaces, a first auger 307 is provided in the upper space and a second auger 309 is provided in the lower space. As first auger 207 and second auger 309 are rotated, developer is conveyed while being stirred as shown by an arrow mark in FIG. 4.

Further, a toner density detector 311 is provided in the lower space to detect toner density of developer stirred and conveyed by second auger 309. Toner density detector 311 is so constructed as to detect toner density of two-component developer (a ratio of toner to carrier) by a magnetic sensor that detects the magnetic force (magnetic permeability) of carrier in developer container 303. When the toner density detected by toner density detector 311 becomes below a specified value, developer is supplied into developer container 303 from developer supply container 301.

Next, developer will be explained. Two-component developer comprising toner and magnetic carrier is used for the toner in this embodiment. A toner that is composed of combined resin and colorant as main components was used. Polystyrene, styrene-acrylic copolymer, polyester, epoxy resin, silicon resin, polyamide, paraffin wax are usable for combined resin. For colorant, pigment and dye are used and carbon black, aniline blue, pigment red, pigment yellow, etc. are used. Further, charge controller, cleaning assistant, separation accelerator, fluidity accelerator, etc. can be contained when necessary.

For carrier, magnetic particles such as ferrite, ion oxide, etc. are used and these magnetic particles as core materials and coated with resin are usable. For resin to coat carriers, fluoric, acrylic, silicon resins are usable and also, these materials are usable individually or in combined state of plural kinds. Resins containing magnetic particles are also usable.

Further, developer to be supplied will be explained. A two-component developer composed of toner and carrier is prepared by a mixer. For a mixer, a Henschel mixer, etc. are used. Developer is mostly toner and a small volume of carrier is mixed.

Developer that is supplied contains toner and carrier as described above. Here, toner is consumed in the image forming but carrier remains in developer container 303 of developing device 133. Therefore, when it is tried to maintain the toner density in developer container 303 constant, volume of developer in developer container 303 increases as a result of supply of developer. Therefore, developer in developer container 303 that becomes excess overflows and is discharged through a developer outlet 313 provided on the wall of developer container 303 for the purpose of discharging developer. The developer overflowed is accumulated in an acceptance part 317. Thus, supply and discharge of developer are repeated, deteriorated developer in developer container 303 is replaced by newly supplied developer. Thus, the characteristic of developer is maintained satisfactorily and volume of developer was kept constant.

However, the volume of developer discharged by the overflow is apt to be affected by physical properties of developer.

Figure 5:
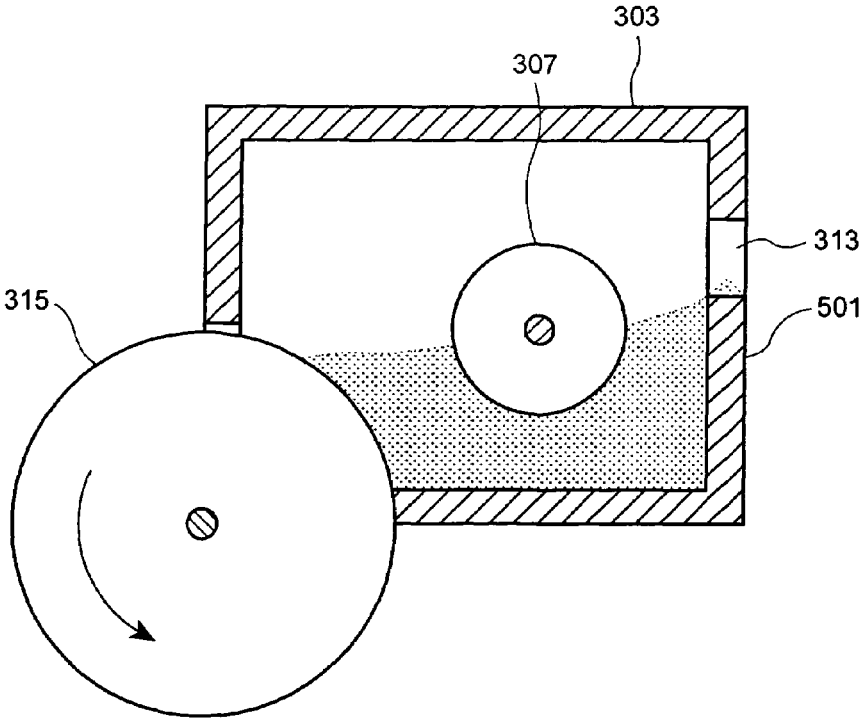
FIG. 5 is a cross-sectional view showing a conventional developer vent.

For example, under the high temperature and humid environment, physical properties of developer changed and volume of developer in developer container 303 was remarkably increased. Causes for increasing developer in developer container 303 under the high temperature and humid environment were analyzed. Developer is discharged through developer outlet 313 as shown in FIG. 5. At this time, developer is deposited on the tip part of a discharge dam 501 that forms developer outlet 313. When the fluidity of developer drops under the high temperature and humid environment, the height of developer deposited on the tip part of the discharge dam 501 increases. When an angle of repose of developer was measured as an index expressing the fluidity of developer, it was measured that the angle of repose of developer became especially high and the fluidity was lowered under the high temperature and humid environment. As the angle of repose becomes large, the height of developer deposited on the tip part of the discharge dam 501 increases. As a result, the substantial height of the discharge dam 501 becomes high and the space of the developer outlet decreases. Accordingly, the discharging volume of developer decreased and the volume of developer in developer container 303 increased. In other words, it is necessary to take the sectional shape of developer output 313 into consideration.

Figure 8:
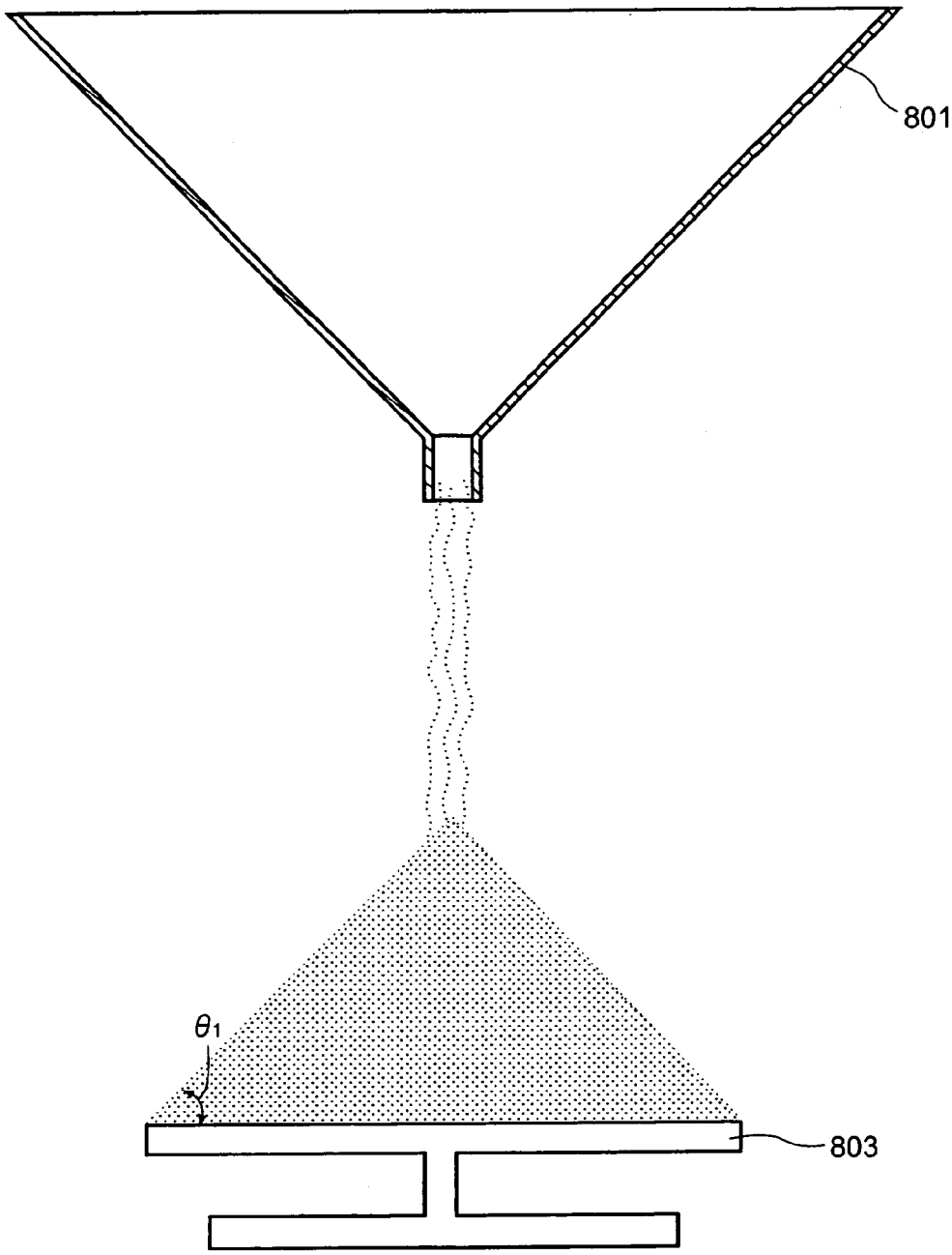
FIG. 8 is a schematic diagram for explaining a method to measure a repose angle of developer.

Here, the measuring method of the repose angle of developer will be explained. The repose angle was measured as an index of fluidity of developer as described above. In the measurement, developer is dropped on a dish 803 from a funnel 301 as shown in FIG. 8. Developer is deposited in a heaped shape on dish 803 at a slanting angle θ 1. When developer is deposited and the slanting angle reaches a certain value, the heaped shape collapses. A critical angle of this collapse was made an angle of repose. The angle of repose was substantially measured using the initial developer.

Figure 6:
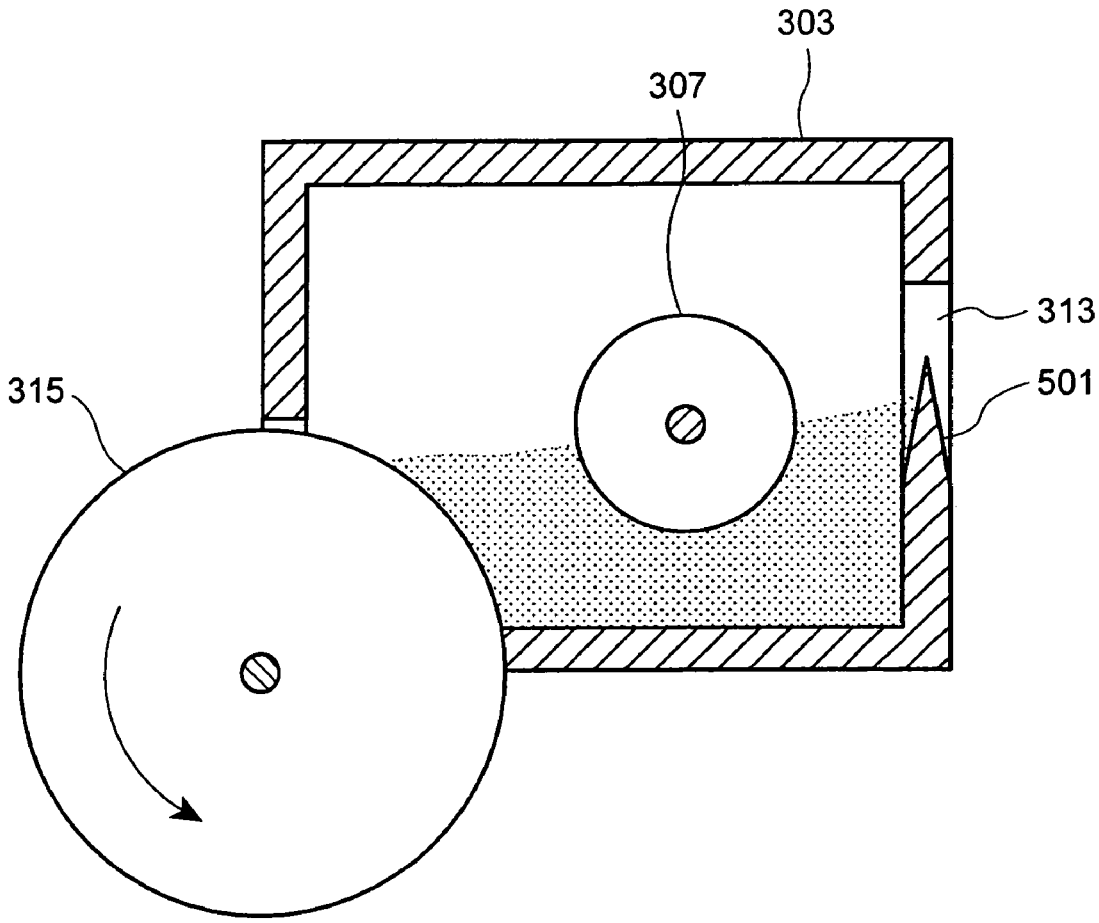
FIG. 6 is a cross-sectional view showing a discharge dam which is an embodiment of the present invention.
Figure 7:
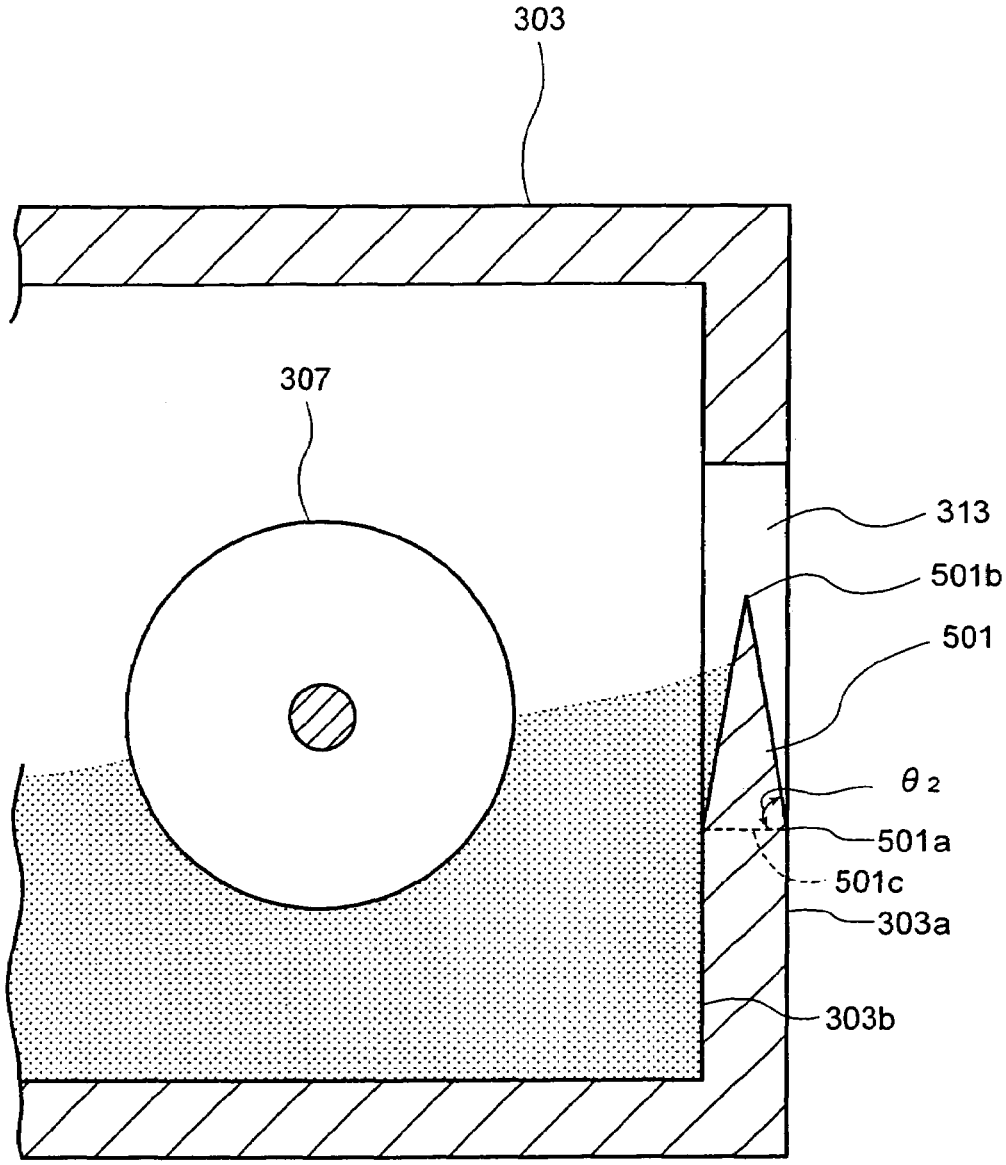
FIG. 7 is an enlarged cross-sectional view of FIG. 6.

Next, discharge dam 501 in this embodiment will be explained. Shown in FIG. 6 is discharge dam 501 of this embodiment in developer outlet 313. FIG. 7 is an enlarged portion of developer outlet 313 shown in FIG. 6. Discharge dam 501 in this embodiment is in a shape inclined to the top part. The slanting angle θ 2 of the top part of discharge dam 501 is made larger than the repose angle θ 1 of developer.

The slanting angle θ 2 of the slanting part of the top part of discharge dam 501 is an angle that is formed by a line connecting a slating start part of an outer surface 303*a* or an inner surface 303*b* of developer container 303 with a tip part 501*b* of discharge dam 501 and a horizontal line 501*c*. Further, the thickness of tip part 501*b* of discharge dam 501 is made smaller than the wall thickness of developer container 303. Definitely, it is preferable to make the thickness to less than ⅓ of the thickness of the wall of developer container 303 as described later in detail.

The discharge capability of developer when using discharge dam 501 of this embodiment was evaluated. In the evaluation, 2 g of developer are supplied to developer container 303 for every 10 min. to a certain volume. Then, volume of developer at the time when the supply and discharge of developer was stabilized is obtained. Here, a difference between a volume of developer under normal temperature and humid environment (for example, temperature 23° C., humidity 50%) and an increased volume of developer under a high temperature and humid environment (for example, temperature 30° C. and humidity 85%) is made as an increased volume of developer. Then, the relation of the increase of developer to the slanting angle θ 2 of discharge dam 501 with the relation of the thickness of tip part 501*b* of discharge dam 501 to the thickness of the wall of developer container 303 is evaluated.

Figure 9:
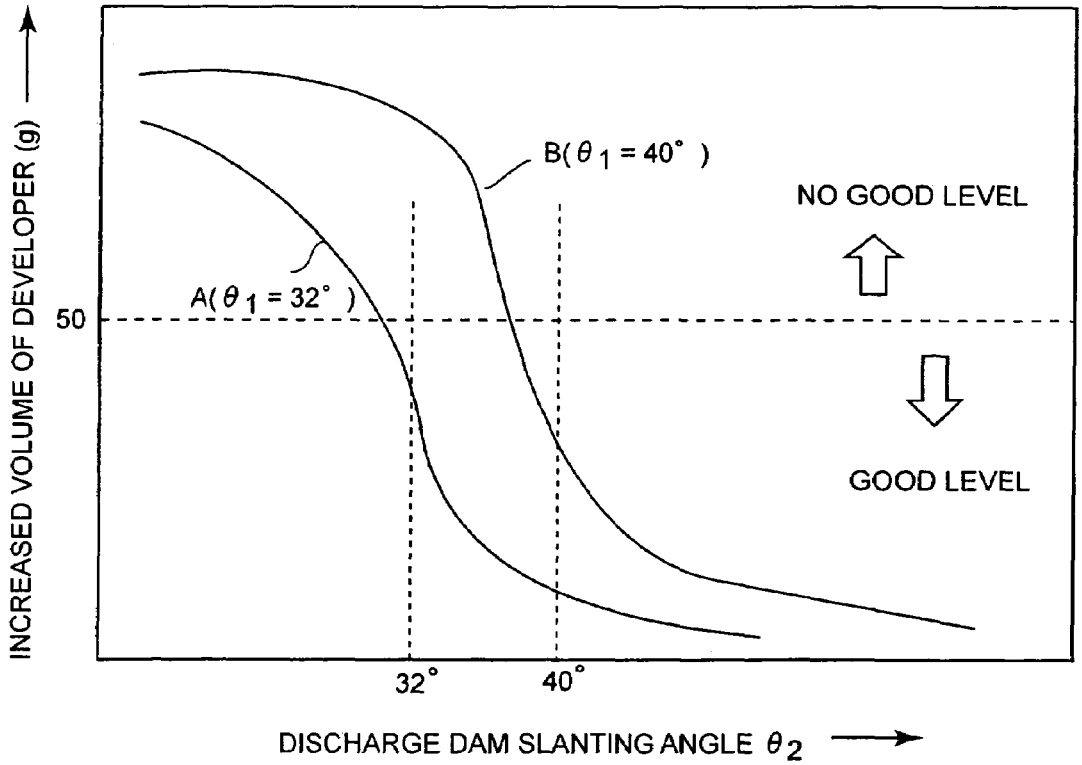
FIG. 9 is a graph showing the relation of an increased volume of developer to the inclined angle of the discharge dam.

FIG. 9 shows the relation of an increased volume of developer to slanting angle θ 2 of discharge dam 501. For this evaluation, two kinds of developers; developer of a repose angle θ 1 of 32° and developer of a repose angle θ 1 of 40° were used. Further, discharge dam 501 with the tip part in the triangular shape was used. The relation of an increasing volume of developer to the slanting angle θ 2 of discharge dam 501 will be explained referring to FIG. 9.

Because the physical properties of developer under the high temperature and humid environment change as described above, it becomes difficult to discharge developer. As a result, volume of developer increases but when an increasing volume of developer exceeds 50 g, a torque of the auger to convey developer in developer container 303 while stirring becomes large. Further, developer may leak through other parts than developer outlet 313. Therefore, an increasing volume of developer is preferred to be less than 50 g. Based on this, the results of the evaluation are examined.

Regarding developer A, an increased volume is more than 50 g when the slanting angle θ 2 of discharge dam 501 is small, an increased volume is more than 50 g and is not preferred but when the slanting angle θ 2 of discharge dam 501 became 32° that was the repose angle θ 1 of developer A, an increasing volume of developer became lower than 50 g to a good level. Then, regarding developer, when an increased volume of developer was more than 50 g and at a problem level when the slanting angle θ 2 of discharge dam 501 was smaller than the repose angle θ 1. However, when the slanting angle θ 2 of discharge dam 501 became about 40°, an increasing volume of developer became lower than 50 g to a good level. Thus, a discharge volume of developer becomes good when the slanting angle θ 2 is made larger than the repose angle θ 1 of developer.

Figure 10:
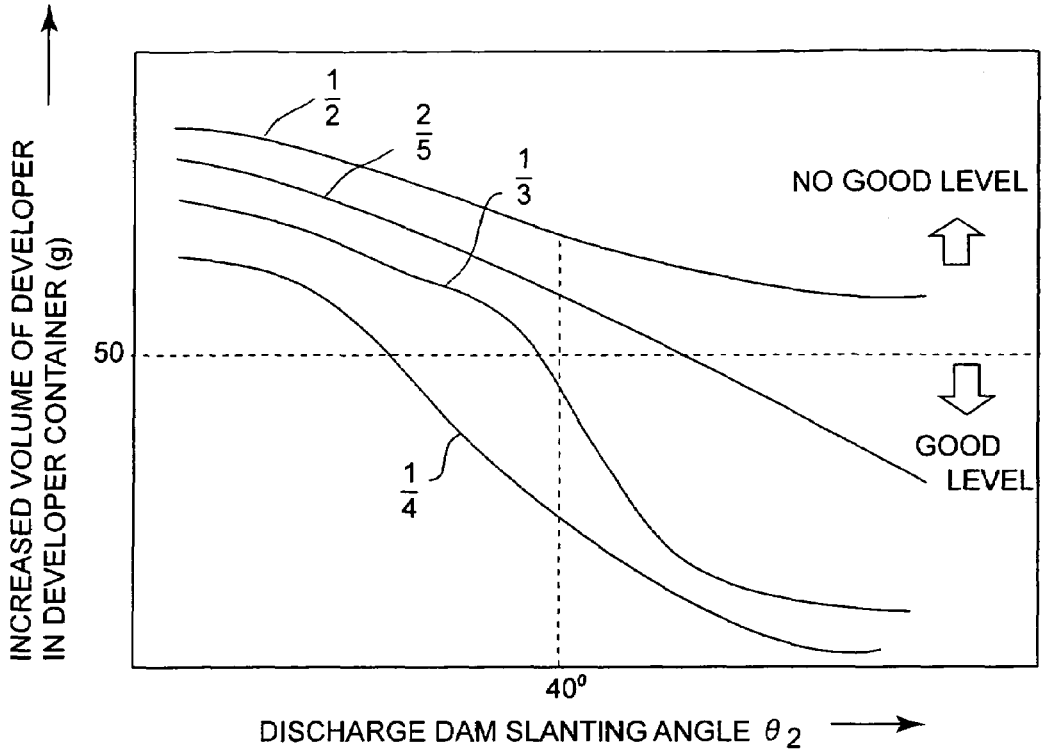
FIG. 10 is a graph showing the relation of the thickness of the tip part of the discharge dam to the thickness of the wall of the developer container.

Next, the relation of the thickness of tip part 501*b* of discharge dam to the wall thickness of developer container 303 with the increase in developer will be explained. In this evaluation, developer was used. FIG. 10 shows the relation of the thickness of tip part 501*b* to the wall thickness of developer container 303 to the increase in developer.

When the thickness of tip part 501*b* of discharge dam 501 was made to ½ of the wall thickness of developer container 30, the increasing volume of developer exceeded 50 g to a level where developing device 133 became hard to operate even if the slanting angle θ 2 of discharge dam 501 was made larger than the repose angle θ 1 of developer. When the thickness of tip part 501*b* of discharge dam 501 was made to ⅔ of the wall thickness of developer container 303, the slanting angle θ 2 of discharge dam 501 becomes considerably larger than the repose angle θ 1 and the increasing volume of developer becomes to a good level. When the thickness of tip part 501*b* of discharge dam 501 was made to ⅓ of the wall thickness of developer container 303, the increasing volume of developer came to the good level when the slanting angle θ 2 of discharge dam 501 was in the vicinity of the repose angle θ 1 of developer. When the thickness of tip part 501*b* of discharge dam 501 was made to below ⅓ of the wall thickness of developer container 303, the increasing volume of developer became a good level when the slanting angle θ 2 of discharge dam 501 was an angle smaller than the repose angle θ 1 of developer.

In other words, if the thickness of tip part 501*b* of discharge dam 501 is thicker than ⅓ the wall thickness of developer container 303 even when the slanting angle θ 2 of discharge dam 501 was made larger than the repose angle θ 1 of developer, developer was hardly discharged. From the results of evaluation described above, it is seen that developer can be discharged satisfactorily by reducing the thickness of tip part 501*b* of discharge dam 501 to ⅓ of the wall thickness of developer container 303 or below even when the environment is shifted from normal temperature and humid condition to the high temperature and much humid condition.

The physical properties of developer change in the environmental change; however, change somewhat according to the output of a large number of images. So, the discharge volume of developer in the output of a large number of images was evaluated. In this evaluation, the discharging volume of developer in the conventional shape of discharge dam (FIG. 5) was compared with that in the discharge dam 501 of the slanting angle θ 2 made larger than the repose angle θ 1 of developer and tip part 501*b* of discharge dam 501 in a triangular shape.

Figure 11:
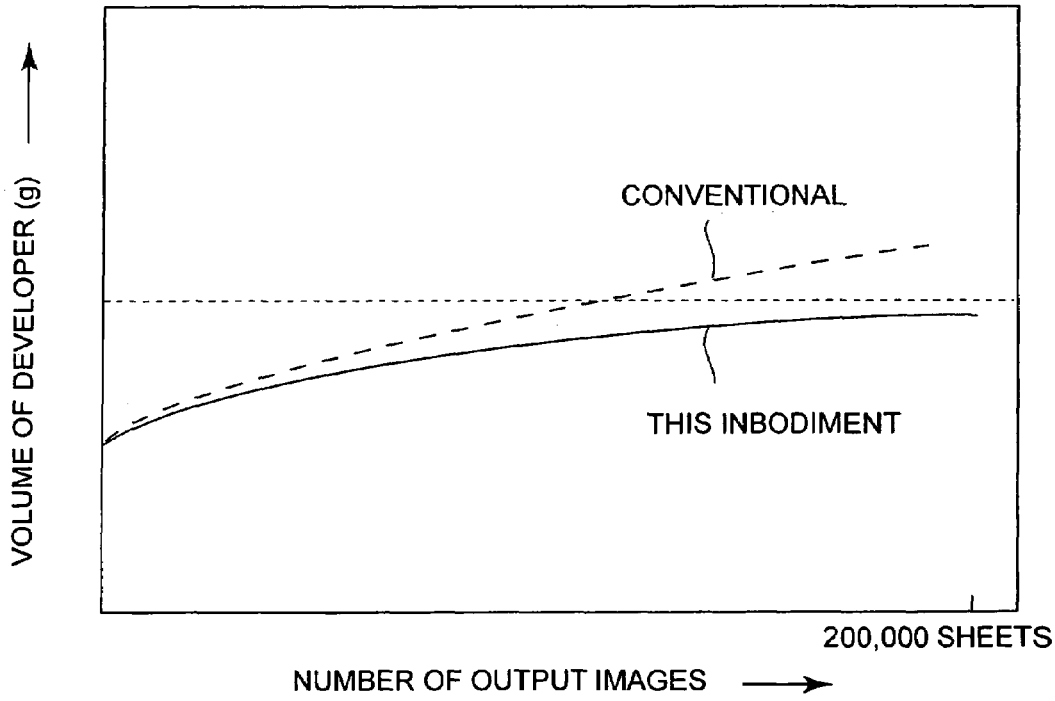
FIG. 11 is a graph showing the evaluation result of the discharge volume of developer at the output of a large volume of images.

FIG. 11 shows the evaluation result. As shown in FIG. 11, when discharge dam 501 in the conventional shape was used, a large number of images are output and developer in developer container 303 is deteriorated and hardly discharged. As a result, volume of developer in developer container 303 was increased to a level to impede the operation of developing device 133. In the case where the slanting angle θ 2 of discharge dam 501 was made larger than the repose angle θ 1 of developer and tip part 501*b* of discharge dam 501 was made in the triangle shape, developer was discharged favorably even if developer was deteriorated by the output of a large number of images and hardly discharged.

As a result, the slanting angle θ 2 of discharge dam 501 is made larger than the repose angle θ 1 and the thickness of tip part 501*b* of discharge dam 501 is made to ⅓ of the wall thickness of developer container 303 like discharge dam 501 in this embodiment. Thus, changes in developer physical properties by the environment or by the output of a large number of images can be coped with and a good discharging environment was realized.

Embodiment 2

Discharge dam 501 is desirable in the shape of the slanting angle θ 2 larger than the repose angle θ 1 of developer with tip part 501*b* of discharge dam 501 with the thickness below ⅓ of the wall thickness of developer container, and in Embodiment 1, discharge dam 501 is in a triangular shape.

Figure 12:
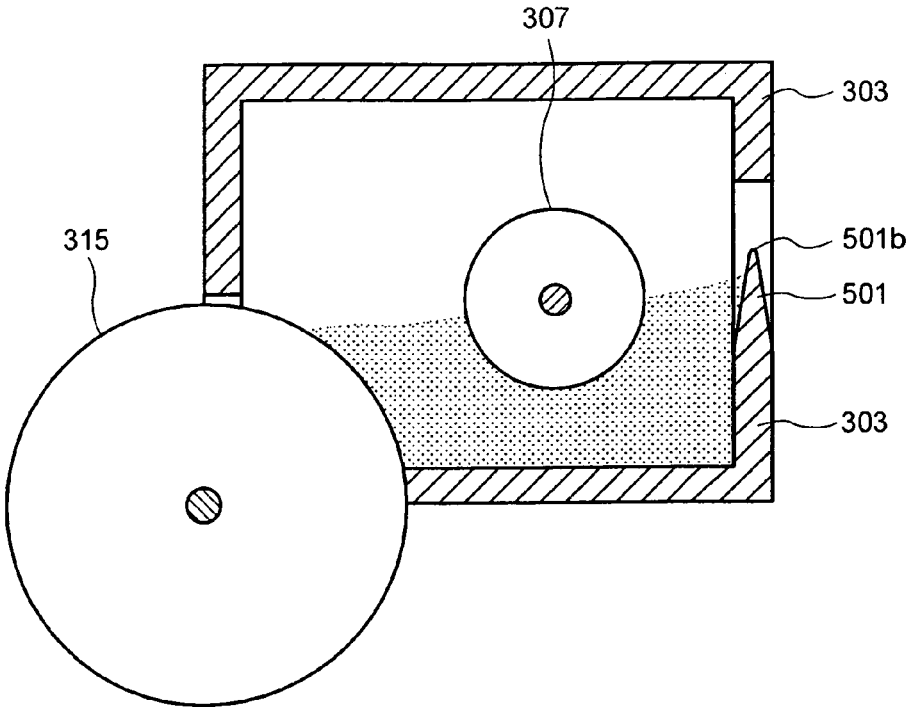
FIG. 12 is a cross-sectional view showing the discharge dam which is another embodiment of the present invention.
Figure 13:
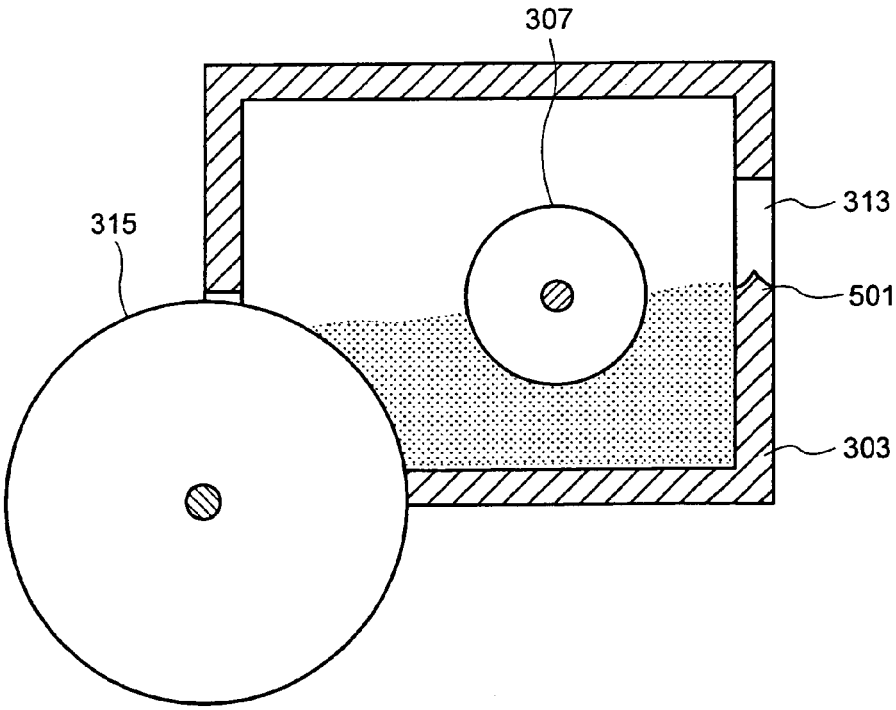
FIG. 13 is a cross-sectional view by showing the discharge dam as a curved line as another embodiment.

However, provided that the above conditions are satisfied, the shape of discharge dam 501 is not restricted to the triangular. For example, tip part 501 of discharge dam 501 may be in a shape provided with chamfers as shown in FIG. 12. Further, the incline of discharge dam 501 can be a curve as shown in FIG. 13. However, when the incline is a curve, a curve entering into the inside of a line connecting the slanting start part and tip part 501 of the discharge dam is preferred.

Figure 14A:
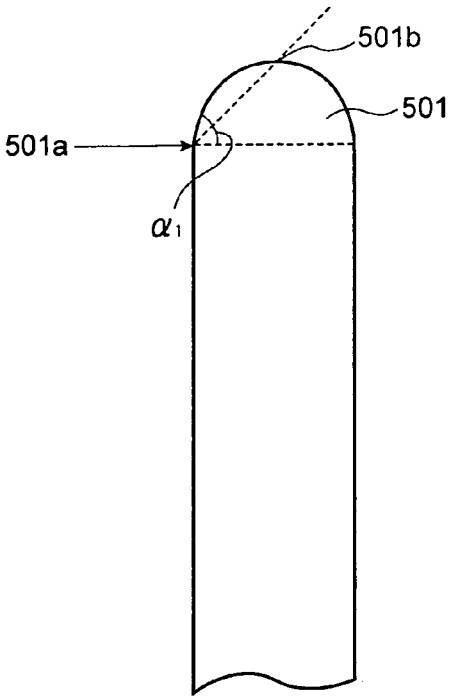
FIG. 14A and FIG. 14B are schematic diagrams for explaining the discharge dam presented as a curved line.
Figure 14B:
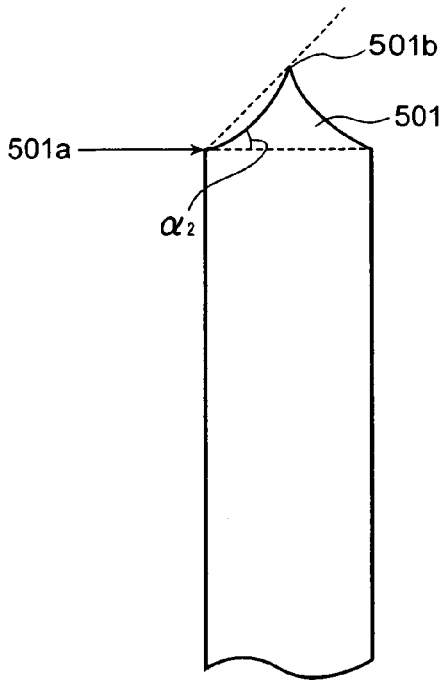

This will be explained. When an angle α 1 formed by the curve of the incline is larger than a line connecting tip part 501*b* of discharge dam 501 to lower slanting start part 501*a*, the effect of changing the shape of discharge dam 501 is low and the discharging performance is not favorable. When an angle α 2 that is formed by a horizontal line and the slanting start part is smaller than an angle formed by a horizontal line and a line connecting slanting start part 501*a* of discharge dam 501 below tip part 501*b* of discharge dam 501, the discharge performance becomes good as shown in FIG. 14B.

Figure 15:
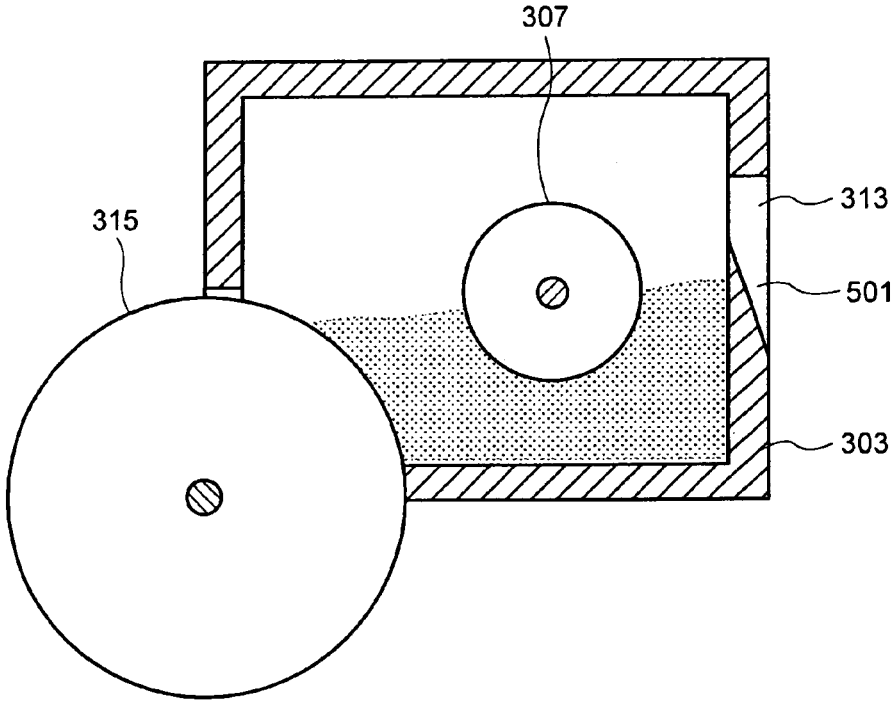
FIG. 15 is a cross-sectional view showing the discharge dam which is another embodiment.

Further, when discharge dam 501 is in the triangular shape, it may be in such a shape that one side of discharge dam 501 is slanted as shown in FIG. 15 in addition to a shape of discharge dam 501 of which both sides are slanted.

Discharge dam 501 is not restricted to the shape used in the above embodiment and can be any shape that satisfies the thickness of tip part 501*b* of discharge dam 501 below ⅓ of the wall thickness of developer container 303.

According to the present invention, a developer device, a process cartridge and an image forming apparatus capable of making the fluctuation of developer volume in the developer container small by stably discharging developer by making the shape of the discharge dam forming the discharge port in a characteristic shape can be provided.

What is claimed is:

1. A developing device comprising:

a developer container to house developer comprising toner and carrier;

a discharging part provided on a wall part of the developer container to discharge the developer; and a discharge dam of which tip part is in the thickness thinner than a thickness of the wall and an inclined angle in the horizontal direction is larger than a repose angle of the developer in the sectional shape and forms at least a part of the discharging part.

2. The developing device according to claim 1, wherein a thickness of the tip part of the discharge dam is less than ⅓ of the thickness of the wall.

3. The developing device according to claim 1, wherein the sectional shape of the discharge dam is a triangular shape.

4. The developing device according to claim 1, wherein the sectional shape of the discharge dam is a curve entering into the inside.

5. A process cartridge that is mounted detachably to an image forming apparatus, comprising:

a photosensitive drum;

a main charger to charge the surface of the photosensitive drum;

a developing member to develop an electrostatic latent image formed on the surface of the photosensitive drum;

a developer container to house developer comprising toner and carrier to be supplied to the developing member;

a discharging part provided on a wall of the developer container to discharge the developer; and a discharge dam of which tip part is in the thickness thinner than a thickness of the wall and an inclined angle in the horizontal direction is larger than a repose angle of the developer in the sectional shape and forms at least a part of the discharging part.

6. The process cartridge according to claim 5, wherein a thickness of the tip part of the discharge dam is less than ⅓ of the thickness of the wall.

7. The process cartridge according to claim 5, wherein the sectional shape of the discharge dam is a triangular shape.

8. The process cartridge according to claim 5, wherein the sectional shape of the discharge dam is a curve entering into the inside.

9. An image forming apparatus comprising:

a photosensitive drum;

a main charger to charge the surface of the photosensitive drum;

an exposing device to form an electrostatic latent image by exposing the surface of the photosensitive drum charged by the main charger;

a developing member to develop the electrostatic latent image;

a developer container to house developer comprising toner and carrier to be supplied to the developing member;

a discharging part provided on a wall of the developer container to discharge the developer; and a discharge dam of which tip part is in the thickness thinner than a thickness of the wall and an inclined angle in the horizontal direction is larger than a repose angle of the developer in the sectional shape and forms at least a part of the discharging part.

10. The image forming apparatus according to claim 9, wherein a thickness of the tip part of the discharge dam is less than ⅓ of the thickness of the wall.

11. The image forming apparatus according to claim 9, wherein the sectional shape of the discharge dam is a triangular shape.

12. The image forming apparatus according to claim 9, wherein the sectional shape of the discharge dam is a curve entering into the inside.

* * * * *